US005735706A

United States Patent [19]

Ito

[11] Patent Number: 5,735,706

[45] Date of Patent: Apr. 7, 1998

[54] CRAMPING CONNECTOR

[75] Inventor: Osamu Ito, Yokkaichi, Japan

[73] Assignee: Sumitomo Wiring Systems, Ltd., Japan

[21] Appl. No.: 743,914

[22] Filed: Nov. 5, 1996

Related U.S. Application Data

[63] Continuation of Ser. No. 554,868, Nov. 7, 1995, abandoned, which is a continuation of Ser. No. 320,954, Oct. 12, 1994, abandoned.

[30] Foreign Application Priority Data

Oct. 26, 1993 [JP] Japan ..... 5-291292

[51] Int. Cl.[6] ..... H04R 4/24

[52] U.S. Cl. ..... 439/402

[58] Field of Search ..... 439/395, 401–407, 439/418

[56] References Cited

U.S. PATENT DOCUMENTS

| | | | |
|---|---|---|---|
| 3,804,971 | 4/1974 | Bazille, Jr. | 439/402 |
| 3,880,489 | 4/1975 | Dauser, Jr. | 439/402 |
| 3,899,236 | 8/1975 | Santos | 439/402 |
| 4,023,883 | 5/1977 | Raposa et al. | 439/404 |
| 4,278,314 | 7/1981 | Moser et al. | 439/404 |
| 4,496,206 | 1/1985 | Markwandt et al. | 439/404 |
| 4,538,873 | 9/1985 | Worth | 439/404 |
| 4,643,507 | 2/1987 | Coldren | 439/402 |
| 4,693,533 | 9/1987 | Szczeony et al. | 439/350 |
| 4,822,299 | 4/1989 | Rider | 439/402 |
| 5,148,217 | 9/1992 | Neall, III et al. | 439/403 |

FOREIGN PATENT DOCUMENTS

| | | | |
|---|---|---|---|
| 0090317 | 10/1983 | European Pat. Off. . | |
| 0286577 | 10/1988 | European Pat. Off. . | |
| 2537789 | 6/1984 | France . | |
| 3708782 | 9/1988 | Germany . | |
| 61-77564 | 5/1986 | Japan . | |
| 2161994 | 1/1986 | United Kingdom | 439/402 |

*Primary Examiner*—Neil Abrams
*Assistant Examiner*—Brian J. Biggi
*Attorney, Agent, or Firm*—Jordan B. Bierman; Bierman, Muserlian and Lucas

[57] ABSTRACT

A cramping device for connecting two wires includes a housing having generally cylindrical slots which are parallel to and spaced apart from each other. A branch wire, terminates in one slot, and a main wire, which extends through the housing, is in the other slot. A retaining hole is provided into which the end portion of the branch wire is placed. Since the hole is at an angle to the slot, the branch wire is bent when the adjacent portion is placed in the slot. The bend assists in retaining the branch wire in its slot when it is forced against a contact which fits transversely across the slots, penetrates the insulation on the wires, and makes electrical contact therebetween. The slots may have narrowed portions near their outer edges to aid in retaining the wires in position. Preferably, a cover is provided which can enclose the housing. The cover and housing can be locked in a partially mounted position and a fully mounted position. In the former case, the pressing section of the cover retains the wires adjacent the upper edges of the slots; in the latter case, it forces the wires into the slots and against the connector to provide the electrical contact.

13 Claims, 7 Drawing Sheets

FIG.8
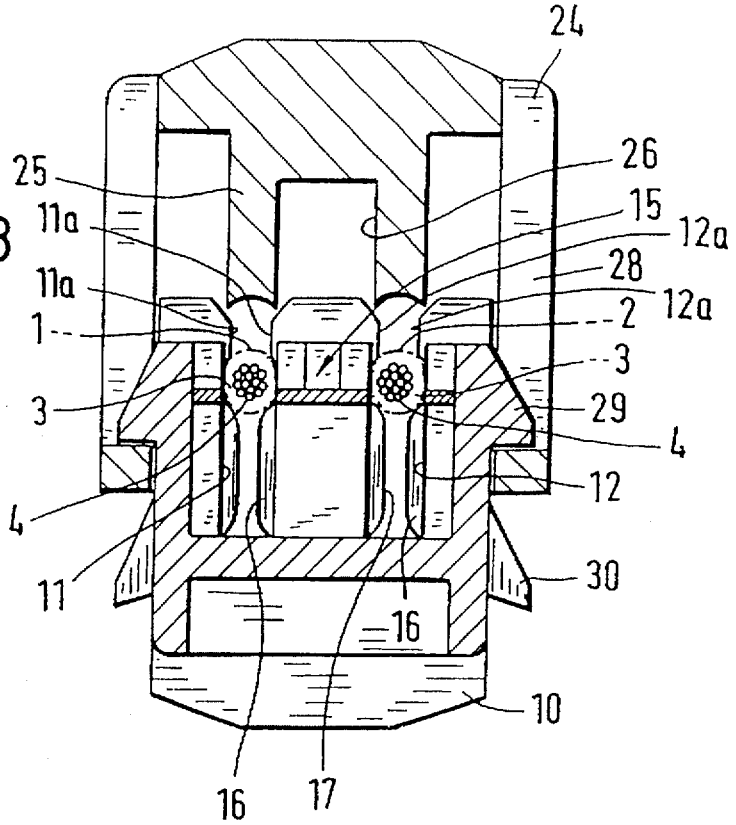
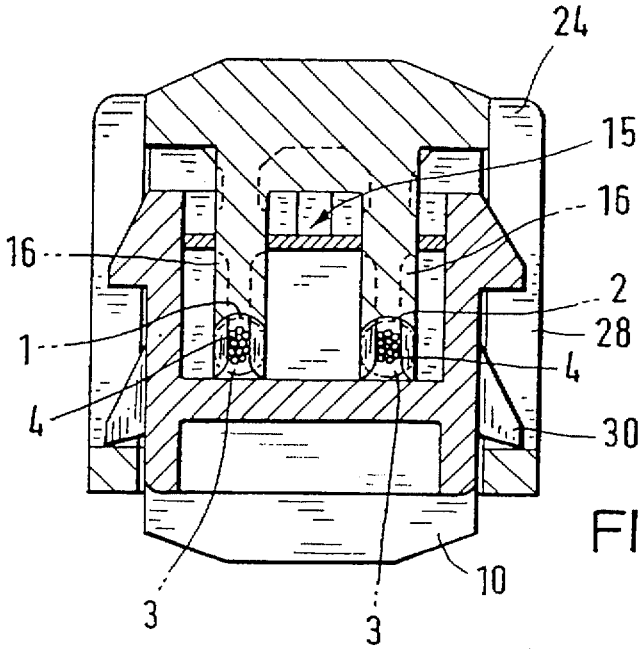
FIG.9

CRAMPING CONNECTOR

This application is a continuation, of application Ser. No. 08 / 554,868, filed Nov. 7, 1995, now abandoned which is a continuation of Ser. No. 08/320,954 , filed Oct. 12, 1994, now abandoned.

This Application claims the priority of Japanese Application 5/291292, filed Oct. 26, 1993.

This invention relates to a cramping connector for connecting an insulated branch wire with an insulated main wire, or for electrically connecting a plurality of insulated branch wires.

BACKGROUND OF THE INVENTION

A cramping device known to the prior art is shown in FIGS. 12 and 13. Tubular openings b and c are located side-by-side in housing a, and cramping contact terminal d having two legs is mounted insertably and transversely of the axes of openings b and c on an upper face of housing a. Opening b is adapted to accommodate main insulated wire 1 over its entire length. Opening c is provided with a wall defining an inner end thereof and adapted to accommodate an end portion of branch insulated wire 2.

Main wire 1 is inserted into opening b along slit e which is formed in the outer side wall defining opening b in a direction normal to its axis; the end portion of branch wire 2 is axially inserted into opening c. Thereafter, when cramping contact d is pressed inwardly, e.g. by the use of pliers, both legs of contact d penetrate the insulation of wires 1 and 2, thereby contacting the cores thereof and forming an electrical connection therebetween. Finally, the upper part of terminal d is covered by cover member f.

However, problems arise because wires 1 and 2 can move axially within openings b and c. Therefore, when cramping contact terminal d is pressed in, wires 1 and 2 may become displaced from their proper positions and thus may not be properly cramped. Particularly, when branch wire 2 moves, it is cramped only slightly, which may cause the leg of cramping terminal d to lose contact with the core of wire 2 and, in an extreme case, may even come out of opening c. The smaller the diameter of the wire relative to the diameter of opening, the more marked are these problems of displacement.

In order to avoid these problems, the cramping operation is carried out while the wires are hand held. This operation is disadvantageous in terms of working efficiency because it is very difficult to hold the tiny wires properly and they tend to be displaced, thereby requiring several attempts before the connection has been successfully accomplished. The cramping connector according to the invention is designed to avoid the above problems.

SUMMARY OF THE INVENTION

Due to the present invention, displacement of the insulated wires in the slots during the cramping operation is avoided and the wires can be electrically connected at their proper predetermined positions. Further, since it is not necessary to hold the wires by hand during the cramping operation, the operation can be carried out more efficiently.

A retaining hole is formed in the housing so that an end portion of each insulated branch wire may be inserted therein, the retaining hole extending at an angle to—and contiguous with—its corresponding slot. The preferable angle is 90 degrees, but it may be smaller or greater. The insulated branch wire is advantageously inserted in the retaining hole, bent toward the slot, and axially fitted therein.

Hence, the coated wire is accommodated in the slot without risk of displacement.

In another embodiment, the slots include holding portions between their bases and their outer longitudinal edges, the holding portions forming a reduced gap between the walls of each slot which is smaller than the outer diameter of the wire to be placed therein. With this feature, the wires can be held in the slots without penetration of their insulation by the cramping contact terminal. It should be appreciated that the holding effect is, in general, not as good as that of the former embodiment. Excellent retention is achieved by a combination of the retaining holes and the holding portions of the slots. Preferably, the holding portions are the upper longitudinal edges of the slots.

Preferably, in the inventive cramping joint connector the housing includes a plurality of slots and a cover which can be mounted on the housing body. When fully mounted, the cover presses the insulated wires into their corresponding slots and forces them against the cramping terminal so that the insulation is penetrated thereby, and contact is made with their conductive wire cores. More preferably, a locking mechanism is provided between the housing and the cover to hold the cover in a partially mounted position on the housing, wherein the cover does not press the coated wires into corresponding slots, and a fully mounted position, in which the cover presses the coated wires into their slots.

In use, the end of the insulated branch wire is inserted into the retaining hole and bent so that the adjacent portion is fitted into the corresponding slot. This avoids any likelihood of displacement. The cover is then moved to its partially mounted position, thereby securing the insulated wire in its slot without forcing it adjacent the cramping terminal. Thereafter, the cover is moved to its fully mounted position, as by the use of pliers, thereby causing the cramping terminal to penetrate the insulation and make contact with the conductive core of the wires.

Thus, by virtue of the invention, displacement of the wires is prevented, thereby enabling them to be cramped securely in their proper positions. They do not have to be held by hand, nor is it necessary to hold the cover manually, since it can be locked in its partially mounted position. Accordingly, the cramping operation can be carried out quickly and efficiently.

Preferably, the cramping terminal is inserted into its position in the housing before the insulated wires. The terminal preferably includes cutters against which the insulated wires are pressed to complete electrical contact.

In a further advantageous form of the connector, at least one slot extends longitudinally through the housing so as to accommodate therein intermediate parts of the main wire(s); there are also slots with one end closed to accommodate the end portions of the branch wires. Thus, the cramping device including these slots is used to connect the branch wire(s) with the main insulated wire(s) and enables the cramping operation to be performed accurately and efficiently.

BRIEF DESCRIPTION OF THE DRAWINGS

FIG. 8 is a section along line 8—8 of FIG. 6;

FIG. 9 is a section along line 9—9 of FIG. 10;

DETAILED DESCRIPTION OF THE INVENTION

Figure 1:
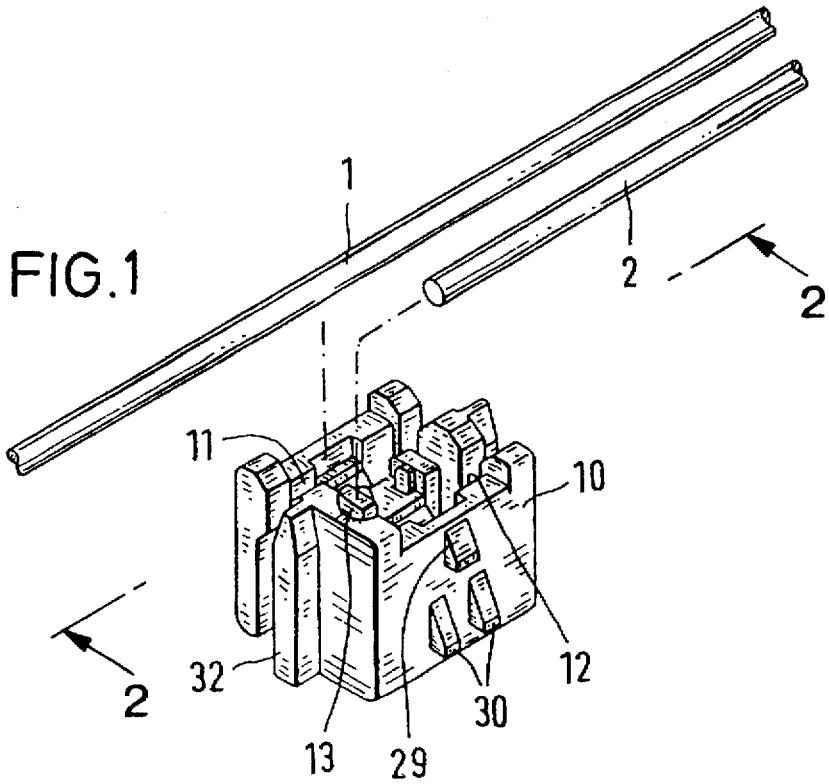
FIG. 1 is a perspective view showing the housing of one embodiment of the invention.
Figure 1:
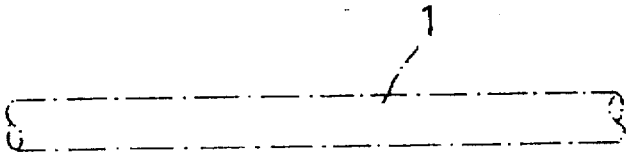
Figure 2:
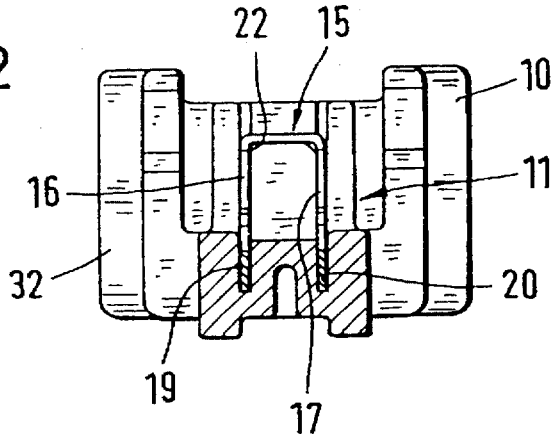
FIG. 2 is a section along line 2—2 of FIG. 1.

The connector of the present invention connects branch insulated wire 2 with main insulated wire 1. Slots 11 and 12 are spaced apart, parallel to each other, and located in the upper part of housing body 10, which is preferably of synthetic resin. Slot 11 is a through slot extending from one longitudinal end of housing body 10 to the other longitudinal end thereof and adapted to accommodate an intermediate portion of main wire 1. Slot 12, one longitudinal end of which is open and the other longitudinal end of which is closed, is adapted to accommodate an end portion of branch wire 2. The depth of slots 11 and 12 is substantially equal to the height of the center portion of housing body 10, and the width thereof corresponds essentially to the diameter of wires 1 and 2.

Figure 3A:
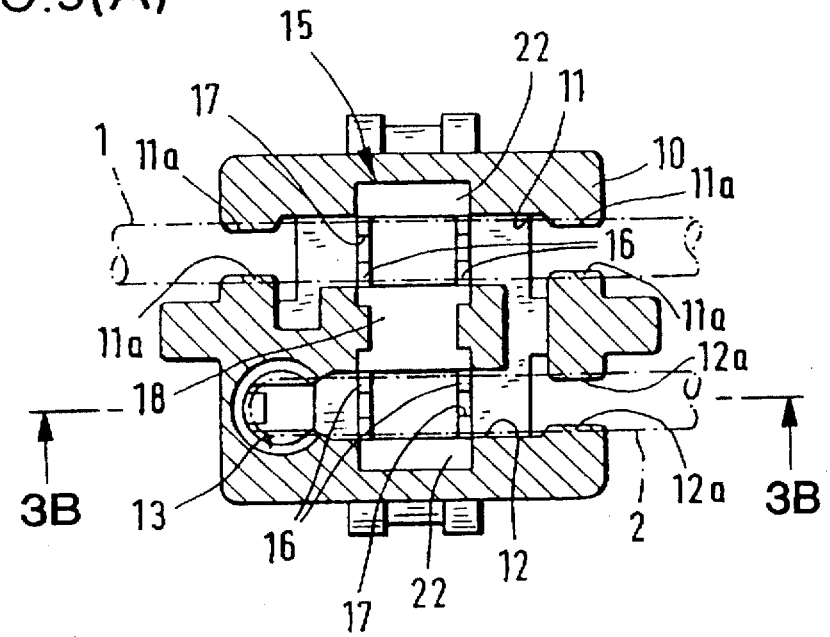
FIG. 3A is a section along line 3A—3A of FIG. 3B with the insulated wires in phantom.

However, slots 11 and 12 are slightly smaller at upper longitudinal ends 11*a* and 12*a* so that wires 1 and 2 are retained thereby when they have been inserted into the slots (see FIGS. 3A and 8).

Figure 3B:
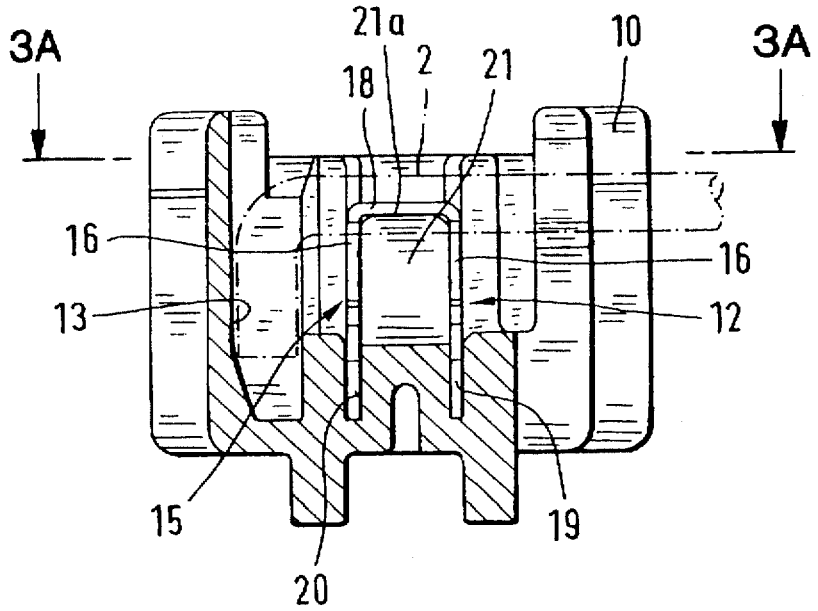
FIG. 3B is a section along line 3B—3B of FIG. 3A with the branch wire in phantom.

As shown in FIGS. 3A and 3B, at the closed end of slot 12 is retaining hole 13 into which the end portion of branch wire 2 is inserted. Hole 13 extends toward the bottom face of housing 10 and is contiguous to and in communication with slot 12.

Between slots 11 and 12, cramping contact 15 of conductive material is mounted. Terminal 15 comprises cutters 16, one pair in each of slots 11 and 12, connected through connecting portion 18. Preferably, there are two pairs in each slot, spaced apart longitudinally. Slit 17 is formed by cutters 16 extending transversely to the direction of the slots, so that the insulated wires can be pressed into the pairs of cutters 16 to cause penetration of the insulation thereby. The pairs of cutters 16 fit into corresponding slots 11 and 12 and insertion portions 19, projecting downward from the bottom ends of the respective cutters 16, are inserted into corresponding insertion holes 20 at the bottom faces of slots 11 and 12. As particularly visible in FIGS. 3A and 3B, when cramping contact 15 is at its predetermined position, connecting portion 18 contacts upper face 21*a* of partition wall 21 between slots 11 and 12; also, holding portions 22 at the outer side ends of contact 15 are in contact with the outer side walls of slots 11 and 12.

Figure 4:
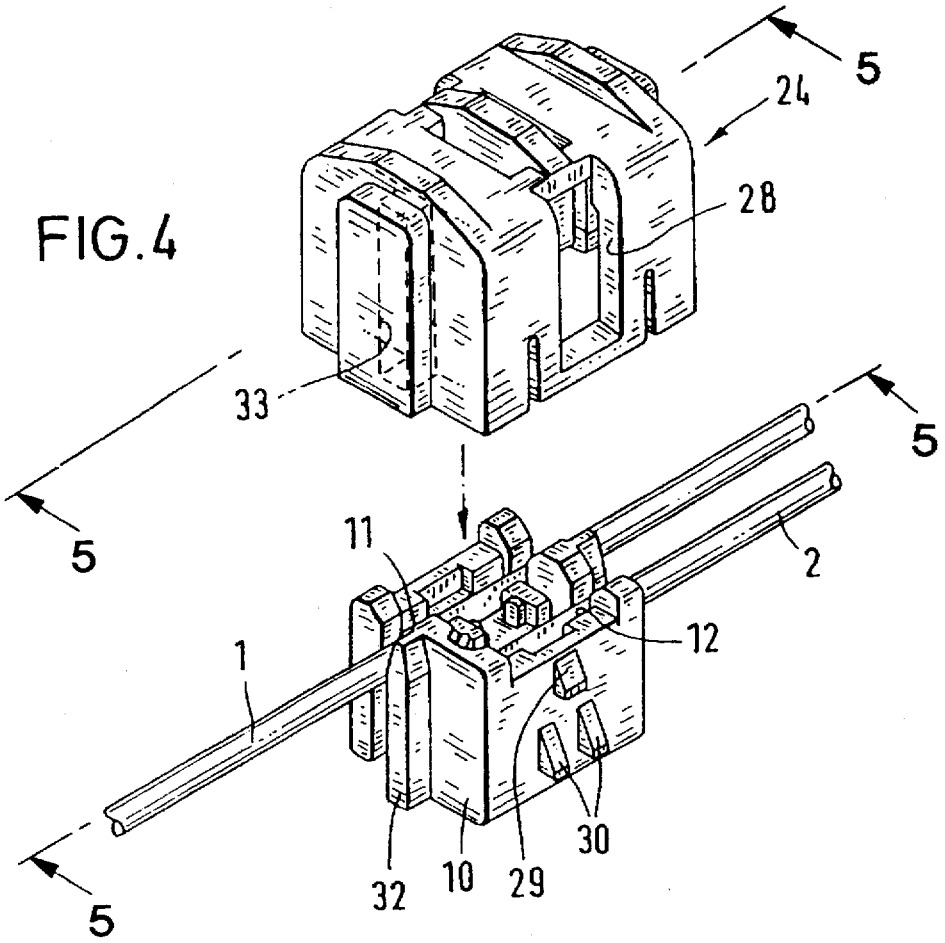
FIG. 4 is an exploded perspective view of the housing and cover, indicating the movement of the cover to its mounted position.
Figure 5:
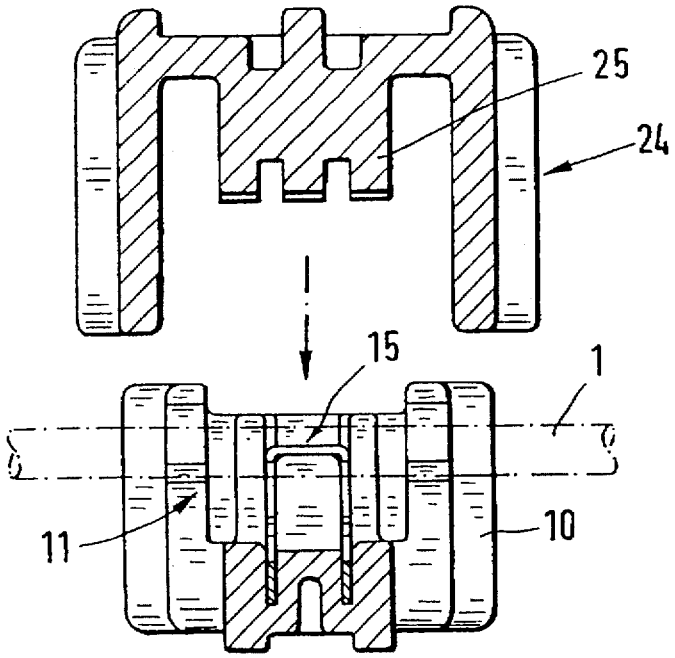
FIG. 5 is a section along lines 5—5 of FIG. 4.

As shown in FIGS. 4 and 5, housing body 10 may also be provided with cover 24, preferably of synthetic resin. As shown in FIG. 5, pressing portion 25 projects downward from the upper inner face of cover 24. Pressing portion 25 is intended to force wires 1 and 2 toward the bases of slots 11 and 12. Recess 26 is formed in pressing portion 25 (see FIG. 8) so that pressing portion 25 may exert force on wires 1 and 2 without pressing cramping contact 15.

Figure 6:
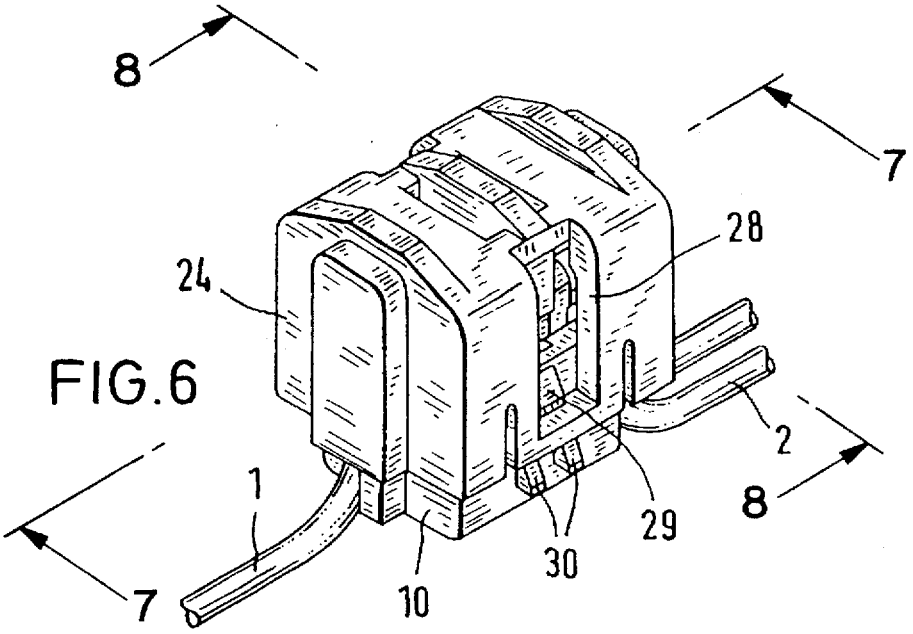
FIG. 6 is a perspective view wherein the cover is on the housing in its partially mounted position.
Figure 10:
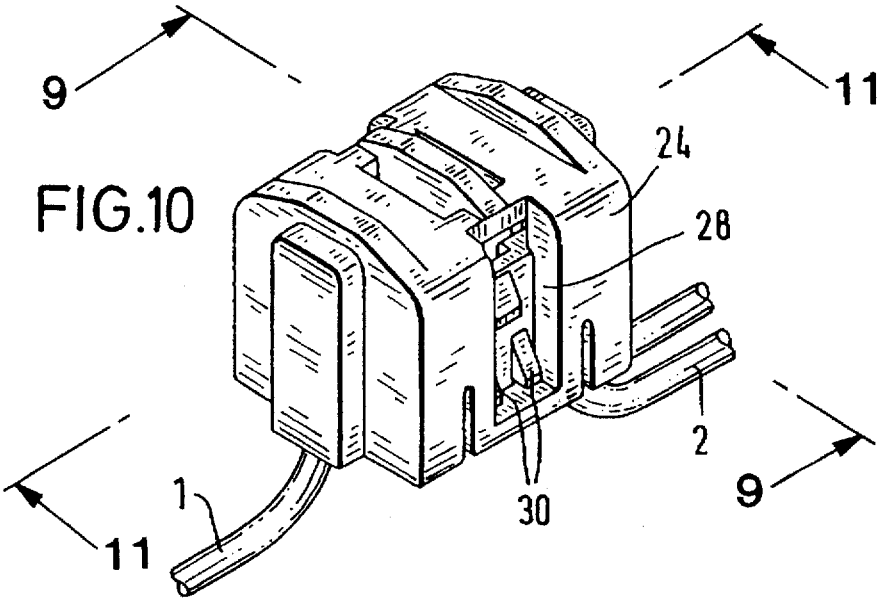
FIG. 10 is a perspective view, similar to that of FIG. 6, wherein the cover is in its fully mounted position.
Figure 11:
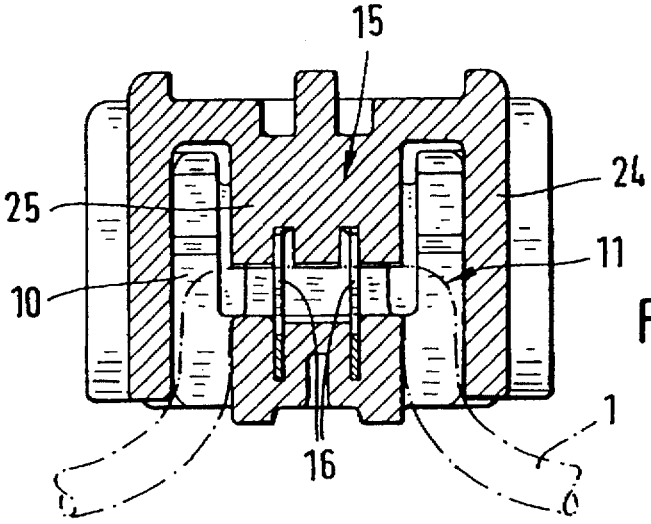
FIG. 11 is a section along line 11—11 of FIG. 10.
Figure 12:
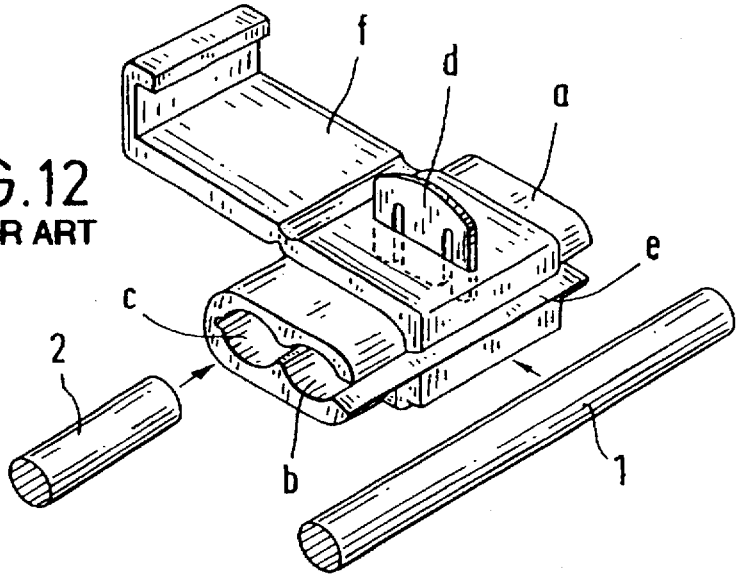
FIG.12 PRIOR ART
FIG. 12 is a perspective view, analogous to that of FIG. 4 showing a prior art device.
Figure 13:
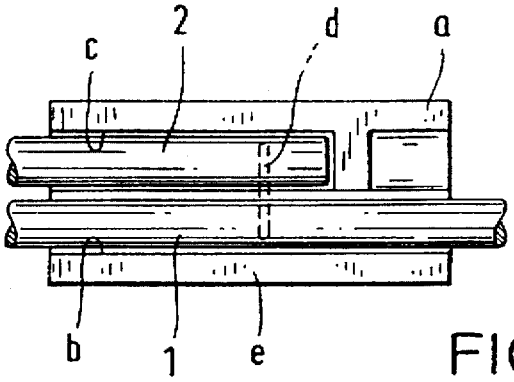
FIG.13 PRIOR ART
FIG. 13 is a plan view, with parts omitted for clarity, of FIG. 12.

According to FIGS. 4 and 10, window 28 is formed in each side face of cover member 24, and first locking projection 29 and two second locking projections 30 are on each side face of housing body 10, first locking projection 29 being located above the juxtaposed second locking projections 30. As can be seen in, for example, FIGS. 6 and 10, first locking projections 29 engage the lower edges of windows 28 when cover member 24 is partially mounted, and second locking projections 30 are engaged thereby when cover member 24 is fully mounted.

On each longitudinal face of housing body 10 is formed rib 32 extending in a vertical direction. On each corresponding longitudinal face of cover member 24 is groove 33 engageable with corresponding rib 32. As cover 24 is placed on housing 10, ribs 32 and grooves 33 cooperate to guide it into mounted position.

The wires are mounted in housing body 10 by fitting an intermediate part of main wire 1 into slot 11 along its upper edge, it thereby being retained by upper longitudinal ends 11*a*. Branch wire 2 is inserted into retaining hole 13, bent to form an angle with the inserted portion, and fitted into the slot 12 along its upper edge, it thereby being held by upper longitudinal end 12*a*.

Subsequently, as indicated by the arrows in FIGS. 4 and 5, the upper face of housing body 10 is covered with cover 24, such that ribs 32 engage corresponding grooves 33. Cover member 24 is pressed further downward while being guided by ribs 32 and grooves 33. The lateral lower edges of cover 24 move over first locking projections 29, which come into locking engagement with the lower edges of corresponding windows 28. In this way, cover member 24 is mounted and locked on housing body 10 in its partially mounted position.

Figure 7:
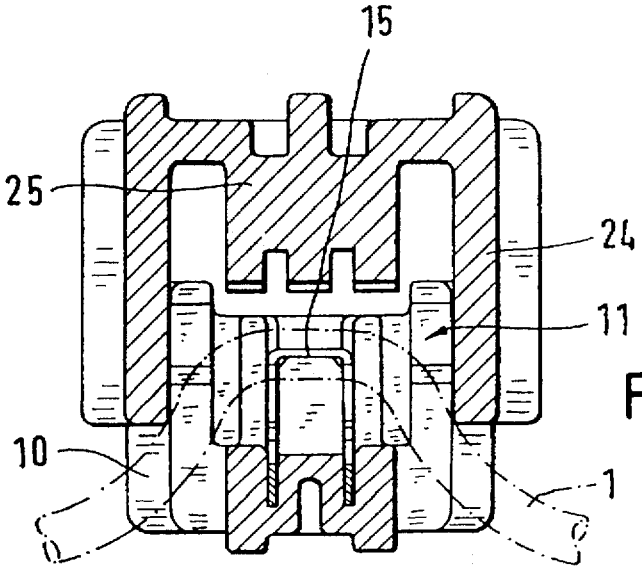
FIG. 7 is a section along line 7—7 of FIG. 6, with the main wire in phantom.

At this point, (see FIGS. 6 and 8), pressing portion 25 of cover 24 does not urge wires 1 and 2 into slots 11 and 12, but is located directly above wires 1 and 2 as shown in FIG. 8. However, as shown in FIG. 7, the longitudinal lower edges of cover 24 press portions of wire 1 projecting outward from the longitudinal faces of housing body 10, thereby holding wire 1 in a bent position. One of the longitudinal lower edges of cover 24 also presses a portion of branch wire 2 projecting outward from the corresponding longitudinal face of housing body 10, thereby also bending wire 2. Since the end portion of wire 2 is bent and has been inserted into retaining hold 13, wire 2 will neither slip nor come out of position.

Subsequently, the upper face of cover 24 and the lower face of housing 10 are pressed together by, e.g. pliers; this causes cover 24 to move toward the bottom of housing body 10, and the lateral lower edges of cover member 24 move over second locking projections 30, which in turn come into locking engagement with the lower edges of corresponding windows 28, thereby securing cover 24 in its fully mounted position.

During this movement of cover member 24, wires 1 and 2 are forced by pressing portion 25 of cover 24 into corresponding slots 11 and 12. Cutters 16 penetrate insulation 3 of wires 1 and 2 and come into contact with conductive cores 4 thereof, thereby making an electrical connection between wires 1 and 2.

According to the foregoing embodiment, when cover 24 is partially mounted and locked on housing body 10 with cramping contact 15 inserted into housing 10, displacement of main and branch coated wires 1 and 2 is prevented and, therefore, they can be cramped securely at their proper positions. Further, cramping can be carried out efficiently since it is unnecessary to manually hold wires 1 and 2 and cover 24 during this operation.

Although only a limited number of specific embodiments of the present invention have been expressly disclosed, it is understood that such modifications of the invention as would be apparent to the person of ordinary skill may be made without departing from the scope thereof. For example, there may be a plurality of branch wires and/or main wires. In such a case, a corresponding number of slots would be provided, along with retaining holes, cramping contacts, etc. The combination of the housing, two position locking mechanism, and cover need not be used as a cramping connector, but may be used elsewhere, as can the cramping contact. Thus, the claims are to be broadly construed and not to be limited except by the character of the claims appended hereto.

What we claim:

1. A cramping device comprising a housing having at least one first, generally cylindrical slot with a first axis extending in a longitudinal direction, at least one second generally cylindrical slot having a second axis parallel to and spaced apart from said first axis in a transverse direction to said longitudinal direction, said first slot adapted to receive a first insulated branch wire having a conductive core therein, said second slot adapted to receive a second insulated wire having a second conductive core therein, a contact in said housing having cutters thereon so as to penetrate insulation on said first wire and said second wire to form an electrical connection therebetween, when said first wire and said second wire are inserted into said first slot and said second slot respectively, a retainer in said housing to hold said first wire in said first slot while insulation thereon is being penetrated by said connector, a cover adapted to be placed, in an insertion direction, on said housing in a fully mounted position wherein a pressing section on an inner side of said cover forces said first wire and said second wire into said first slot and said second slot respectively and against said contact to form said electrical connection, slots to retain said wires, there being a gap between the walls of each slot with a gap diameter smaller than the outer diameter of the wire therein at adjacent upper longitudinal ends of said slots, said gas being wider than said slots, when said first wire and said second wire are placed thereon without entering said slots, said slot portions restrain said first wire and said second wire against longitudinal and lateral movement.

2. The device of claim 1 wherein said retainer comprises a generally cylindrical retaining hole contiguous to and in communication with said first slot and having a retaining axis at an angle to said first axis, said angle being greater than 0° and less than 180°, said retaining hole adapted to receive an end portion of said first wire.

3. The device of claim 2 wherein said retainer comprises first inwardly projecting portions in said first slot, there being a gap between inner ends thereof, said gap being smaller than a diameter of said first wire.

4. The device of claim 3 wherein said retainer comprises a second pair of inwardly projecting portions in said second slot, there being a second gap between inner ends thereof, said second gap being smaller than a diameter of said second wire.

5. The device of claim 2 wherein said angle does not exceed 90°.

6. The device of claim 1 wherein said retainer comprises first inwardly projecting portions in said first slot, there being a first gap between inner ends thereof, said first gap being smaller than a diameter of said first wire.

7. The device of claim 6 wherein said retainer comprises a second pair of inwardly projecting portions in said second slot, there being a second gap between inner ends thereof, said second gap being smaller than a diameter of said second wire.

8. The device of claim 1 wherein said second slot extends through said housing in said longitudinal direction whereby an intermediate portion of said second wire can be inserted into said second slot.

9. The device of claim 1 wherein said cover has a partially mounted position wherein said pressing section retains said first wire and said second wire adjacent an upper edge of said first slot and said second slot without pressing said first wire and said second wire against said cutter.

10. The device of claim 1 wherein there are two guide ribs, one on each side of said housing.

11. The device of claim 1 wherein said is cover is provided with at least one guide groove which complementary to said guide rib.

12. The device of claim 1 wherein there are two guide grooves which are complementary to said guide ribs.

13. The device of claim 1 wherein there is at least one guide rib on said housing extending perpendicular to said longitudinal direction and parallel to said insertion direction.

* * * * *